US006532907B1

(12) United States Patent
Harrison

(10) Patent No.: US 6,532,907 B1
(45) Date of Patent: Mar. 18, 2003

(54) CONTAINMENT JACKET

(76) Inventor: Thomas Norman Harrison, La Girette, Rue de la Mare, Des Pres, St. John, Jersey JE3 4DH (GB)

( * ) Notice: Subject to any disclaimer, the term of this patent is extended or adjusted under 35 U.S.C. 154(b) by 0 days.

(21) Appl. No.: 09/914,003

(22) PCT Filed: Feb. 28, 2000

(86) PCT No.: PCT/GB00/00667

§ 371 (c)(1),
(2), (4) Date: Dec. 14, 2001

(87) PCT Pub. No.: WO00/51892

PCT Pub. Date: Sep. 8, 2000

(30) Foreign Application Priority Data

Feb. 27, 1999 (GB) ..... 9904508

(51) Int. Cl.[7] ..... B65D 25/20; F22B 37/36
(52) U.S. Cl. ..... 122/494; 220/694.1; 220/592.24
(58) Field of Search ..... 122/494; 220/23.91, 220/694.1, 592.24, 669; 588/259; 383/123, 125

(56) References Cited

U.S. PATENT DOCUMENTS 2,206,680 A * 7/1940 Sitton ..... 220/592.24
3,863,694 A 2/1975 Fisher
4,844,286 A 7/1989 Jacobson
5,711,632 A 1/1998 Garrahan

FOREIGN PATENT DOCUMENTS

| | | |
|---|---|---|
| CA | 2187824 | 4/1998 |
| CA | 2235040 | 11/1998 |
| CH | 671 207 | 8/1989 |
| DE | 9015532 | 1/1991 |

* cited by examiner

*Primary Examiner*—Gregory Wilson
(74) *Attorney, Agent, or Firm*—Christensen O'Connor Johnson Kindness PLLC

(57) ABSTRACT

A jacket (1) is shaped to enclose at least partially a liquid storage vessel (2; 200), the jacket comprising a skin (5) arranged as a plurality of folds (20) which are capable of opening out to permit expansion of the jacket in the event of liquid escaping from the storage vessel, securing means (9*a*, 9*b*, 10*a*, 10*b*, 13*a*, 13*b*, 14*a*, 14*b*; 35) are provided to secure the upper part (32) of the jacket in position with respect to the vessel and to maintain the upper part of the jacket in position in the event of liquid escaping from the vessel. The jacket may be fitted to existing oil tank or new oil tank installations, or may be used with cold or hot water tanks.

11 Claims, 6 Drawing Sheets

CONTAINMENT JACKET

This is a United States national stage application of International application No. PCT/GB00/00667, filed Feb. 28, 2000, the benefit of the filing date of which is hereby claimed under 35 U.S.C. §120, which in turn claims the benefit of British application No. 9904508.0, filed Feb. 27, 1999, the benefit of the filing date of which is hereby claimed under 35 U.S.C. §119.

FIELD OF THE INVENTION

This invention relates to jackets which are to be used primarily around storage vessels containing liquid to retain any liquid which has leaked from the vessel.

BACKGROUND OF THE INVENTION

It is known at present to provide a bund around storage vessels, which contain oil for example. Such bunds conventionally comprise a brick wall which surrounds the storage vessel so as to contain any liquid which has leaked from the vessel. Such bunds, however, can be space consuming and result in the creation of a permanent structure, which may be undesirable.

BRIEF SUMMARY OF THE INVENTION

According to a first aspect of the invention there is provided a jacket which is adapted to enclose at least partially a liquid storage vessel, the jacket comprising a skin arranged as a plurality of folds which are capable of opening out to permit expansion of the jacket in the event of liquid escaping from said storage vessel, characterised by securing means adapted to secure the upper part of the jacket in position with respect to the vessel and to maintain the upper part of the jacket in position in the event of liquid escaping from the vessel.

The inventive jacket may be fitted, for example, to domestic and commercial oil tanks made of steel or plastics. Alternatively it may be fitted to a water tank or hot water cylinder.

Preferably the folds in the skin are arranged, in use, to extend substantially horizontally, the plurality of folds being vertically spaced-apart from one another, and preferably such folds are retained in position by a plurality of vertically extending resilient members.

The jacket preferably comprises a rigid base tray, the lower margin of the skin being sealably attached to the upstanding walls of the tray.

The tray is preferably provided with an outlet through which any leaked liquid retained by the jacket can be drained.

The jacket preferably comprises a cover which is adapted to fit the upper end of the storage vessel, and preferably the cover overlaps with the upper margin of the skin and is external thereto. Such a cover can provide protection against ingress of rainwater for an outside storage vessel.

The securing means may be positioned beneath the cover or/and the upper margin of the skin may be attached to the cover by the securing means.

The invention also comprises a hot water cylinder fitted with a jacket in accordance with the first aspect of the invention.

A hot water cylinder and jacket assembly may be provided with a float valve adapted to sense the level of any leaked water collecting in the space between the cylinder and the jacket, and operative to turn off a water supply to the cylinder.

BRIEF DESCRIPTION OF THE DRAWINGS

Some embodiments of the invention will now be described, by way of example only, with reference to the accompanying drawings in which.

DETAILED DESCRIPTION OF THE INVENTION

Figure 1:
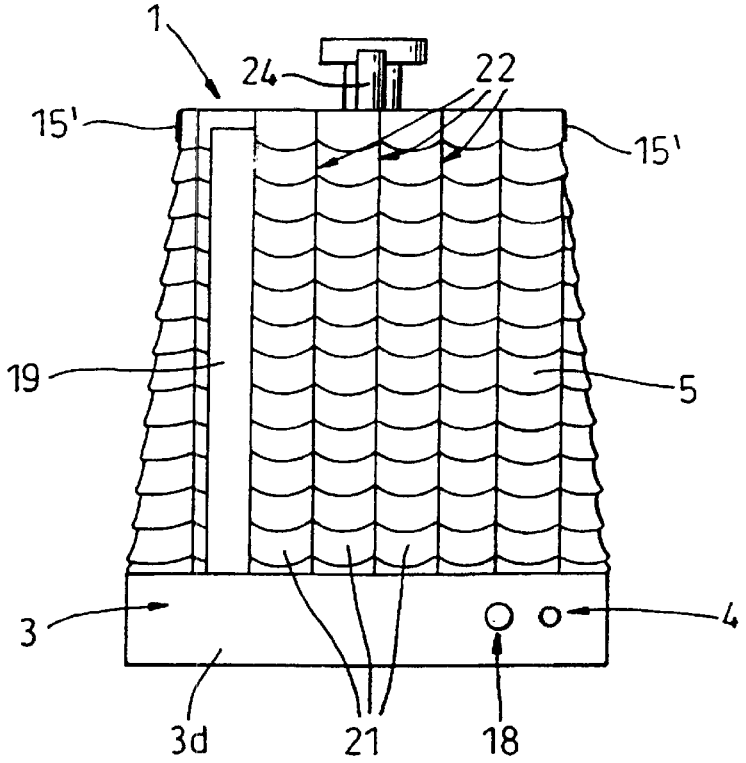
FIG. 1 is a front elevation of a jacket and storage vessel assembly.

FIG. 1 shows a jacket 1, which encloses a rigid rectangular liquid storage vessel 2. The jacket 1 comprises a rigid base tray 3 in which sits the base of the storage vessel 2, and a skin 5 which comprises four upwardly extending walls 5*a*, 5*b*, 5*c* and 5*d*. The lower margins of the walls 5*a*, 5*b*, 5*c*, 5*d* are sealingly attached to respective upstanding peripheral walls 3*a*, 3*b*, 3*c* and 3*d* of the base tray 3.

The skin 5 is arranged as a plurality of folds 20 defined by a plurality of vertically spaced, substantially horizontal, parallel fold lines. The folds 20 are gathered into columns 21 by means of resilient cords 22 which extend up from the lower margin of the skins and are attached to the folds 20 at regular vertically spaced-apart intervals. Folds formed in the skin 5 may alternatively be arranged to extend vertically. The materials of the skin 5 and tray 3 are chosen to be impermeable to the liquid held in the storage vessel 5.

Each wall 5*a*, 5*b*, 5*c* and 5*d* extends upwards towards the top of the storage vessel 2, there being one wall of the skin 5 for each peripheral wall of the storage vessel 2.

Resilient securing straps 9*a*, 9*b*, 10*a*, 10*b*, 13*a*, 13*b*, and 14*a* and 14*b* are disposed around the skin 5 and extend up towards the top of the storage tank. The straps 9*a*, 9*b*, 10*a*, 10*b*, 13*a*, 13*b* and 14*a* and 14*b* are attached to the lower margin of the skin 5 and to the upper margin of the skin 5, in the latter case at points 9*a*', 9*b*', 10*a*', 10*b*', 13*a*', 13*b*' and 14*a*', 14*b*'. The corner straps 9*a* and 9*b* and 10*a* and 10*b* are attached at their free ends to fasteners 12 and 6 respectively. The fasteners 6 and 12 are then connected by means of a horizontal strap 11 which runs longitudinally of the storage vessel 2 and passes through said fasteners.

The free ends of straps 13*b* and 14*b* are attached to fasteners 7 and 8 respectively, whereas the free ends of straps 13*a* and 14*a* are fed through fasteners 7 and 8 respectively. The straps 13*a*, 13*b*, 14*a* and 14*b* thus pass across the width of the storage vessel 2. To enclose a storage vessel within the jacket 1. the upper margin of the skin 5 is brought up against storage vessel 2 by pulling on the free ends of the straps 11, 13*a* and 14*a*.

Figure 4:
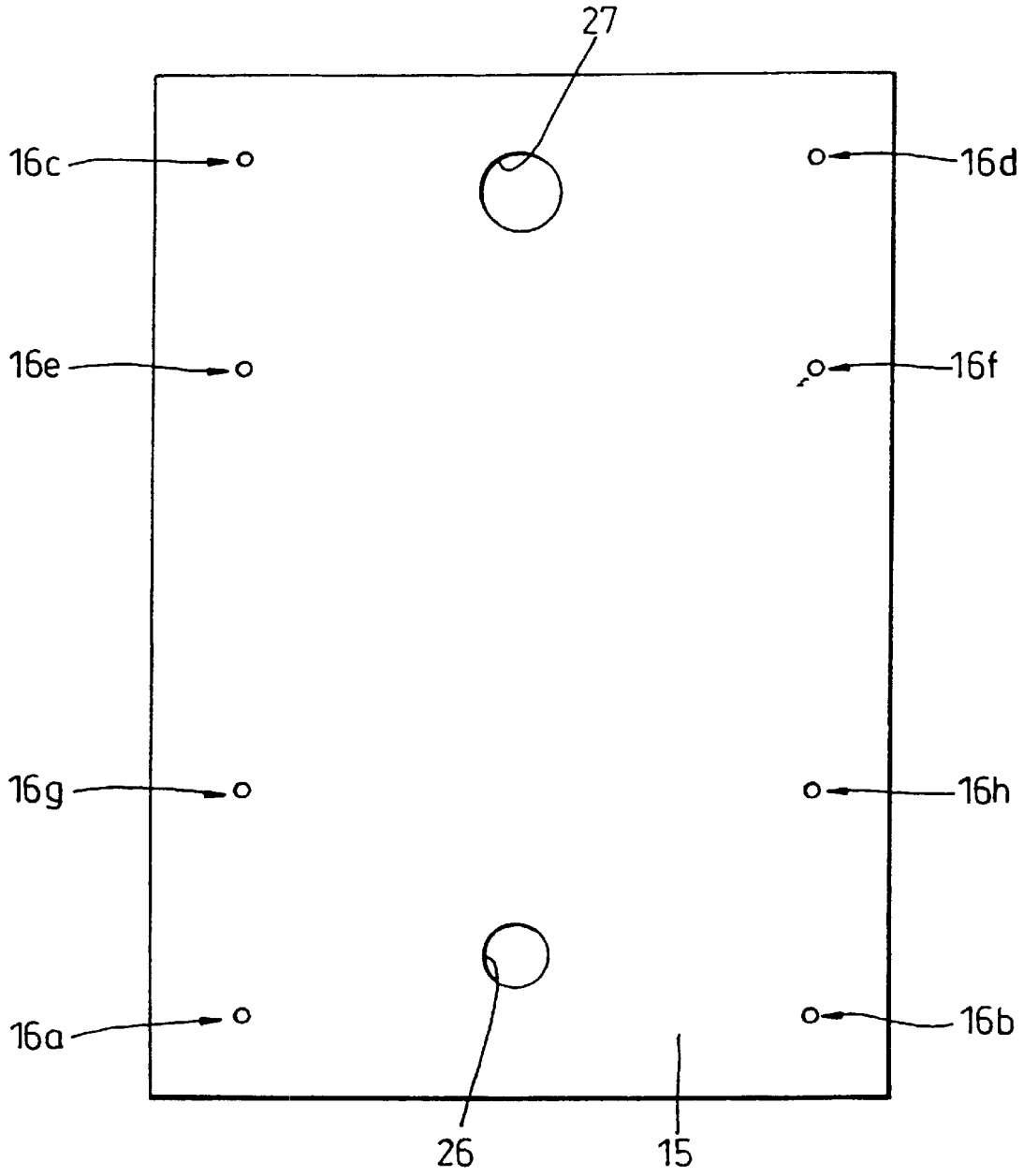
FIG. 4 is a plan view of the top cover of the jacket of FIG. 1.
Figure 5:
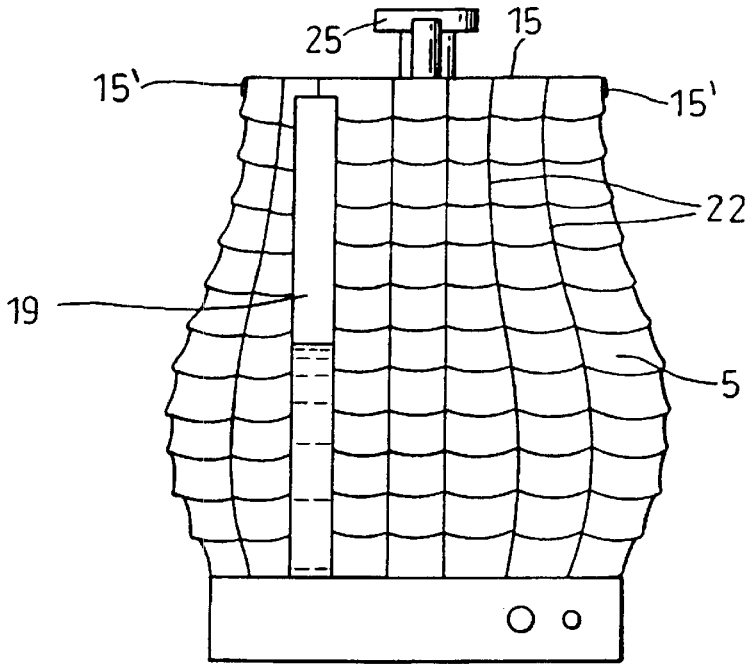
FIG. 5 is a schematic front elevation of the jacket and storage vessel assembly of FIG. 1 in which the storage vessel has ruptured and the jacket is containing the liquid which has escaped from the vessel.
Figure 6:
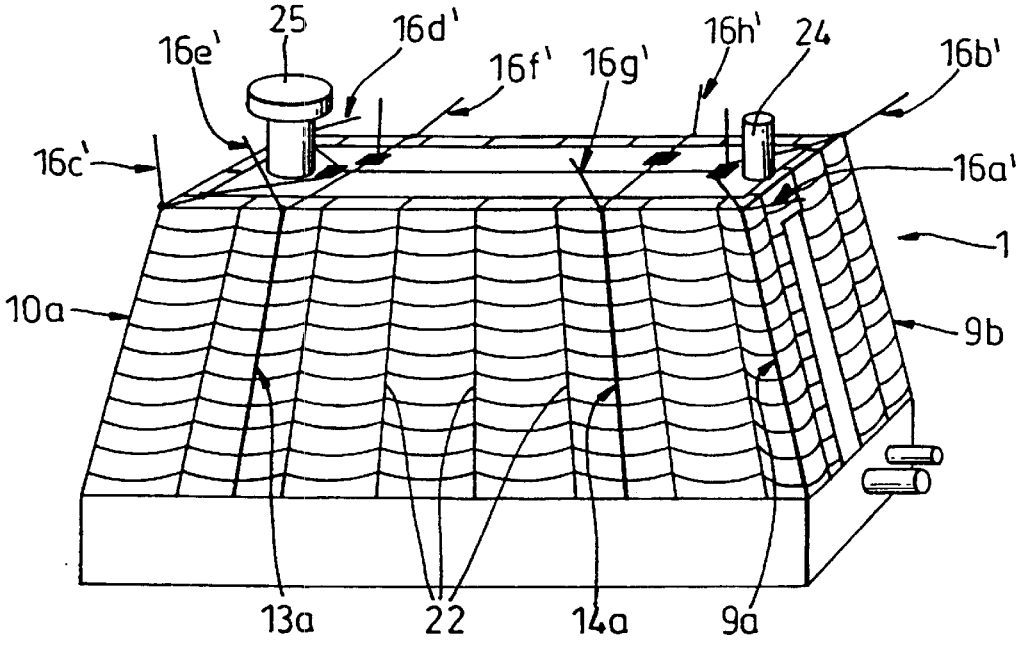
FIG. 6 is a schematic perspective view of the jacket and storage vessel assembly shown in FIG. 2.

FIG. 4 shows a cover sheet 15 which fits onto the top of the storage vessel 2, the cover sheet 15 is provided with eight holes 16*a*–16*h* which are disposed so as to be substantially in register with the points 9*a'*, 9*b'*, 10*a*', 10*b*', 13*a*', 13*b*', 14*a*' and 14*b*'. The cover sheet 15 is of slightly greater dimensions in plan than the rectangular top of the storage vessel 2 so as to overhang the top, at 15', FIG. 5. to protect the vessel 2 from the weather when the vessel 2 is positioned outdoors. The cover sheet is attached to the top of the storage vessel 2 by straps 16*a'*–16*h'* which are provided at points 9*a*', 9*b*', 10*a*', 10*b*', 13*a*', 13*b*', 14*a*' and 14*b*' and which pass through respective holes 16*a*–16*h* and are turned down to be attached to fasteners (not shown) provided on respective straps 9*a*, 9*b*, 10*a*, 10*b*, 13*a*, 13*b*, 14*a* and 14*b*. Apertures 26 and 27 are provided in the cover sheet 15 to accommodate the inlet 24 and the vent 25. Once secured, the cover sheet prevents the ingress of rain into the space 17 which lies between the storage vessel 2 and the skin 5. The vent 25 and the inlet 24 may be provided with detachable caps which fit over and are secured to said vent and said inlet.

The skin wall 5*d* comprises an elongate transparent window 19 which extends from the lower margin of the wall 5*d* up towards the cover sheet 15.

The base tray can be drilled with a hole saw to accommodate the tank outlet which may be in the centre or side of the tray.

The base tray wall 3*d* is provided with a drainage outlet 4. The outlet 4 is in communication with the space 17 and said outlet is connected to a drain or an existing overflow system. The outlet 4 may be fitted with a valve.

The storage vessel 2 comprises an outlet 18 which is in communication with the liquid inside the storage vessel. The storage vessel further comprises an inlet 24 and a vent 25.

Appropriate sealing is provided around the outlets 4 and 18 where they pass through the base tray wall 3*d*.

Figure 7:
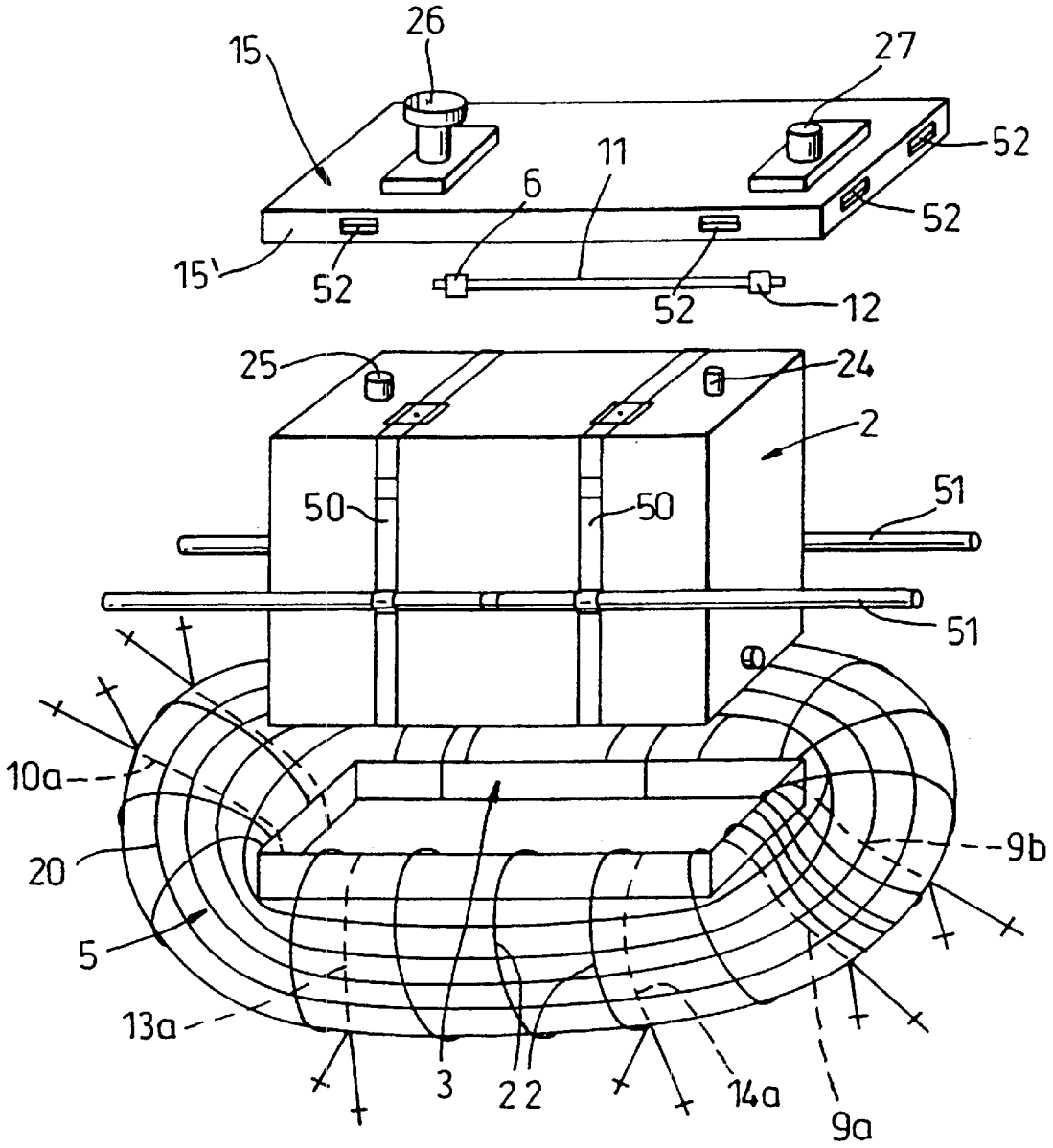
FIG. 7 is a perspective view of the jacket and storage vessel assembly of FIG. 1 prior to installation.

FIG. 7 shows how the jacket assembly can be assembled to a tank 2. The tank 2 can be lifted by the use of suitable straps 50 attached to lifting poles 51. The tray 3 can be placed in position, as shown, with the skin 5 folded downwards and outwards of the tray 3. The tank may then be lowered into the tray 3, and outlet connections can be made to the tank, the straps 50 and poles 51 removed, and then the skin 5 may be folded upwards and secured into place by use of the securing straps 9*a*, 9*b*, 10*a*, 10*b*, 13*a*, 13*b*, 14*a* and 14*b*. The top cover 15 can then be placed in position and secured by passing the strap ends through slots 52.

In use the jacket 1 operates as follows. The jacket 1 is first secured around the storage vessel as hereinbefore described. In the event of rupture of the storage vessel 2 liquid contained in the vessel will begin to pour out into the space 17. The escaped liquid will then flow from the space 17 and through the outlet 4. If the rate at which the liquid flows out from the ruptured storage vessel should be sufficiently high then the space 17 will begin to fill with liquid and the folds 20 will open out and the elasticated cords 22 stretch and thus the jacket will begin to expand, as shown schematically in FIG. 5. It is envisaged that the maximum capacity of the space between the storage vessel and jacket will be approximately 110% of the capacity of the storage vessel. An indication of the quantity of liquid which has escaped from the storage vessel and contained by the jacket is given by viewing the level of escaped liquid in the transparent panel 19.

The inventive jacket 1 can advantageously be designed to fit any shape or size of storage vessel. The jacket ensures that any leakage of liquid from the storage vessel is contained or drained to an appropriate location. The inventive jacket may be used around oil tanks or hot or cold water storage tanks, for example. The jacket can be used with a new tank installation or may be assembled to an existing tank, installation, by suitable lifting of the tank.

Figure 8:
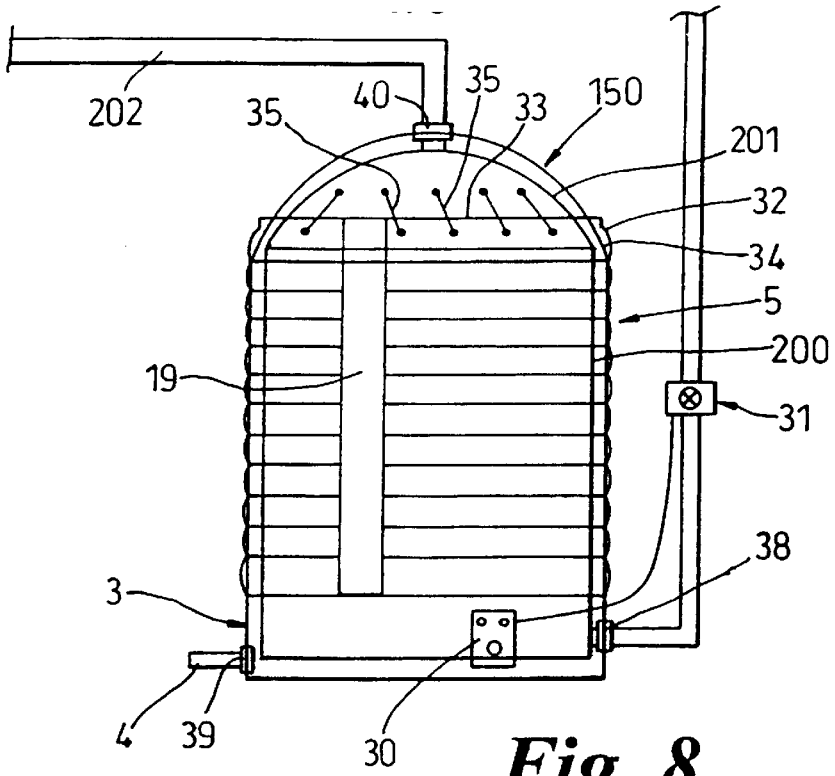
FIG. 8 is a schematic side view of a hot water cylinder of the direct type fitted with a jacket in accordance with the invention, the jacket being shown in its normal unexpanded condition.
Figure 9:
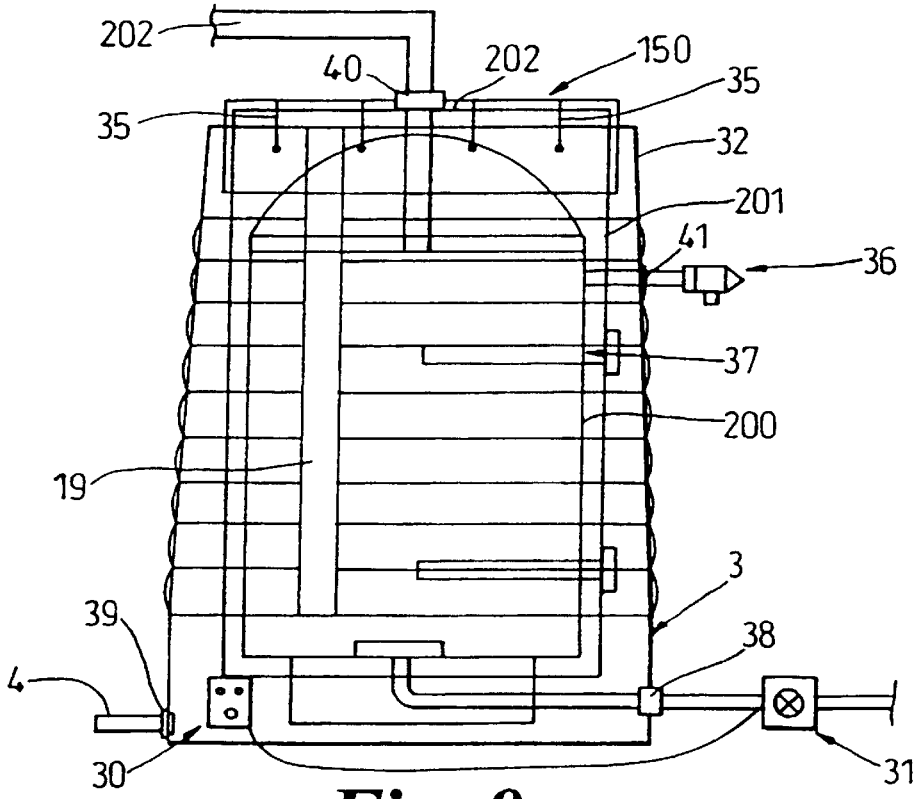
FIG. 9 is a view similar to FIG. 8 of a hot water cylinder of the unvented direct type fitted with a jacket in accordance with the invention.

FIGS. 8 and 9 show installations in which jackets in accordance with the invention have been fitted to hot water cylinders 200 as used in houses. Reference numerals corresponding to those used for the jacket of FIGS. 1 to 6 have been applied to corresponding parts in FIGS. 8 and 9.

Figure 2:
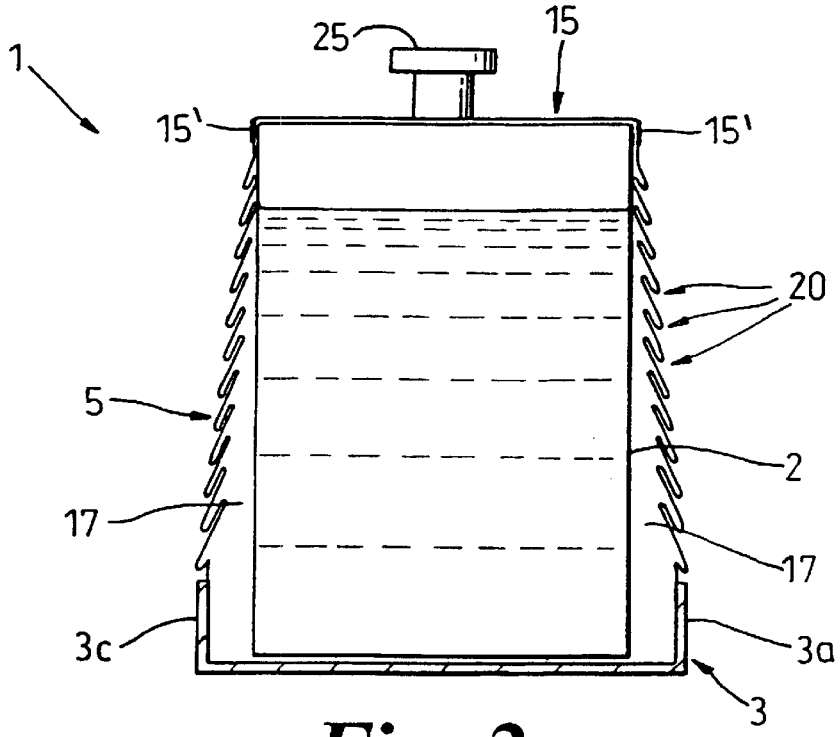
FIG. 2 is a vertical cross-sectional view of the jacket and storage vessel assembly of FIG. 1 taken on line A—A of FIG. 3, with the top cover in position.
Figure 3:
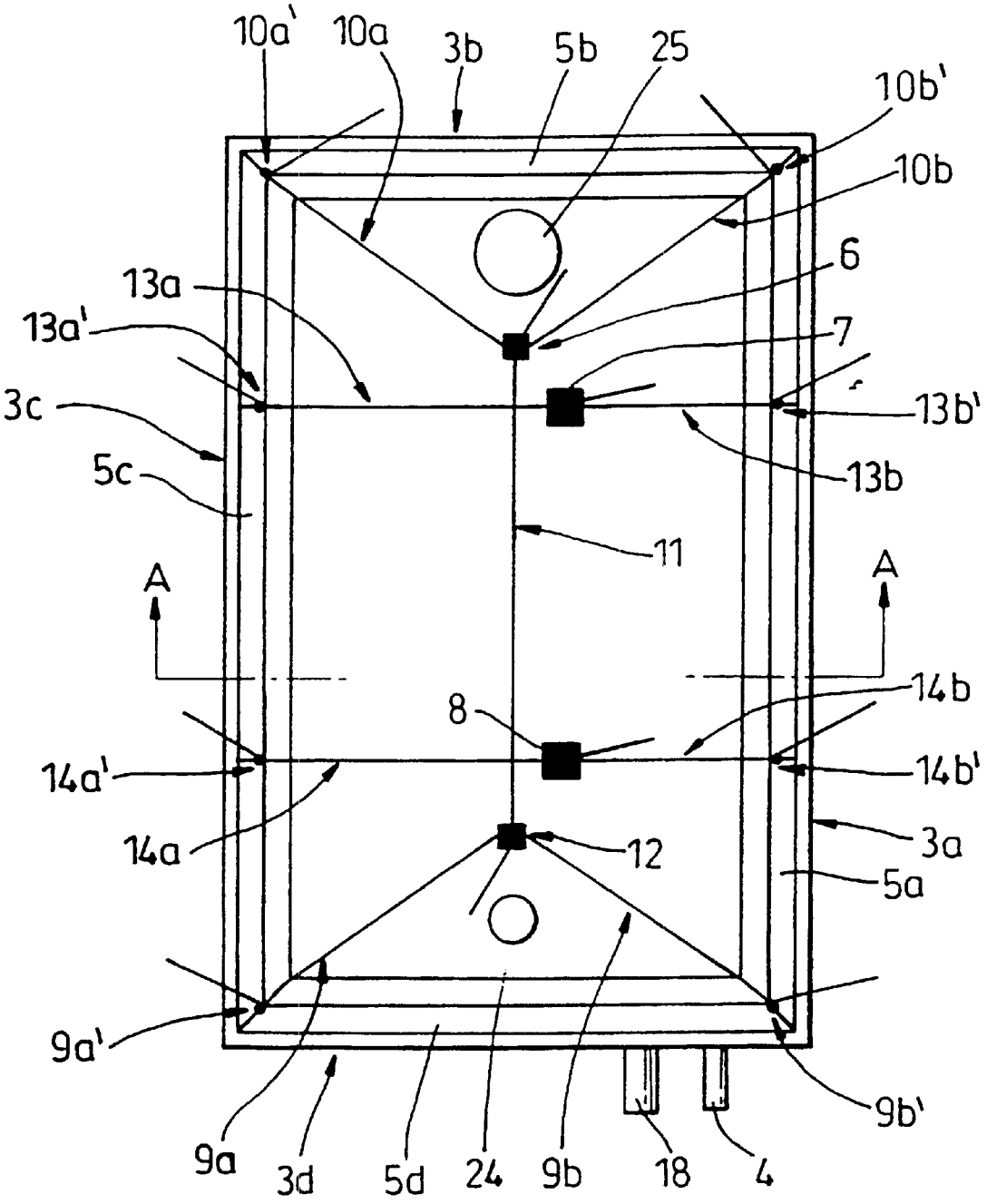
FIG. 3 is a plan view of the jacket and storage vessel assembly of FIG. 1 with the top cover removed.

In FIGS. 8 and 9 the base of the cylinder 200 is received within the cup-shaped base tray 3, and the cylindrical side walls of the skin 5 are folded in a similar manner to the folds shown in FIG. 2, that is, the skin 5 is folded about a series of vertically spaced-apart horizontal fold lines. However, as distinct from the arrangement of FIGS. 1 to 6, there is no need to provide the resilient cords 22 because the hot water cylinder is generally of smaller size than the storage vessel 2 of FIGS. 1, 2.

Another reason why the jacket 3 of FIGS. 8, 9 will not generally be required to contain such a large volume of liquid as may arise with the jacket of FIGS. 1 to 6 is that, advantageously, I provide an arrangement for turning off the supply of water to the cylinder 200 in the event that a cylinder leakage occurs. A float-operated switch 30 is positioned within the base tray 3, and is responsive to the level of any water that begins to collect in the tray in the event of a leak. When the water level trips the switch 30, an electrically-operated shut-off valve 31 is operated to turn off the water supply to the cylinder 200, thereby minimising the quantity of water that can escape from the cylinder 200.

As shown in FIG. 8, the cylinder 200 has the usual domed-top 201 to the centre of which is attached the hot water outlet 202. The cover 150 in the FIG. 8 construction is of part-spherical shape to fit the top 201 of the cylinder, and the upper margin 32 of the skin 5, which terminates at 33, is secured over the outside of the lower margin 34 of the cover 150. The external positioning of the upper margin 32 is possible because there is no requirement to deal with rain.

The upper margin 32 of skin 5 is secured in place to cover 150 by a series of circumferentially-spaced retaining straps 35 attached to respective holes provided in the cover 150. These straps 35 are made sufficiently strong to retain the upper margin 32 in position in the event of a leak causing expansion of the folds of the skin 5.

In the unvented cylinder 200 of FIG. 9, the cylinder 200 is insulated by a rigid foam structure 201 which has a flat top 202. The cover 150 in this case is made of inverted cup-shape, but otherwise the arrangement for securing the cover 150 in position and supporting the upper margin 32 of the skin is the same as in FIG. 8.

In the FIG. 9 assembly a temperature and pressure relief valve is shown at 36, and a heating element at 37. Suitable seals are provided in the jacket at 38, 39, 40 and 41.

If desired, watertight zip fasteners may be provided in regions of the skin 5 to provide access to tank components which may have to be serviced, such as a thermostat.

What is claimed is:

1. A jacket (1) which is adapted to enclose at least partially a liquid storage vessel (2; 200), the jacket comprising a skin (5) arranged as a plurality of folds (20) which are capable of opening out to permit expansion of the jacket in the event of liquid escaping from said storage vessel, characterised by securing means (9*a*, 9*b*, 10*a*, 10*b*, 13*a*, 13*b*, 14*a*, 14*b*; 35) adapted to secure the upper part (32) of the jacket in position with respect to the vessel and to maintain the upper part of the jacket in position in the event of liquid escaping from the vessel.

2. A jacket as claimed in claim 1 characterised in that the folds in the skin are arranged, in use, to extend substantially horizontally, the plurality of folds being vertically spaced-apart from one another.

3. A jacket as claimed in claim 2 characterised in that the folds are retained in position by a plurality of vertically extending resilient members (22).

4. A jacket as claimed in claim 1 characterised by a rigid base tray (3), the lower margin of the skin (5) being sealably attached to the upstanding walls (3*a*, 3*b*, 3*c*, 3*d*) of the tray.

5. A jacket as claimed in claim 4 in which the tray is provided with an outlet (4) through which any leaked liquid retained by the jacket can be drained.

6. A jacket as claimed in claim 1 comprising a cover (15; 150) which is adapted to fit the upper end of the storage vessel.

7. A jacket as claimed in claim 6 in which the cover (15) overlaps (at 15') with the upper margin of the skin and is external thereto.

8. A jacket as claimed in claim 7 in which the securing means are positioned beneath the cover.

9. A jacket as claimed in claim 6 in which the upper margin (32) of the skin is attached to the cover (150) by the securing means (35).

10. A hot-water cylinder fitted with a jacket in accordance with claim 1.

11. A hot-water cylinder and jacket assembly as claimed in claim 10 and comprising a float valve (30) adapted to sense the level of any leaked water collecting in the space between the cylinder and the jacket, and operative to turn off a water supply to the cylinder.

* * * * *